US009157431B2

(12) United States Patent
Smith

(10) Patent No.: US 9,157,431 B2
(45) Date of Patent: Oct. 13, 2015

(54) COUNTERBALANCE SYSTEM FOR PUMPING UNITS

(71) Applicant: Guidemaster Manufacturing Corp., Odessa, TX (US)

(72) Inventor: Alan Daniel Smith, Odessa, TX (US)

( * ) Notice: Subject to any disclaimer, the term of this patent is extended or adjusted under 35 U.S.C. 154(b) by 82 days.

(21) Appl. No.: 13/860,444

(22) Filed: Apr. 10, 2013

(65) Prior Publication Data

US 2013/0283968 A1 Oct. 31, 2013

Related U.S. Application Data

(60) Provisional application No. 61/622,379, filed on Apr. 10, 2012.

(51) Int. Cl.
*F16H 21/32* (2006.01)
*E21B 19/00* (2006.01)
*F04B 47/14* (2006.01)

(52) U.S. Cl.
CPC ..... *F04B 47/14* (2013.01); *Y10T 74/2156* (2015.01)

(58) Field of Classification Search
CPC ..... F04B 47/14; F04B 47/02
USPC ..... 74/41, 589–592; 417/328; 166/75.11
See application file for complete search history.

(56) References Cited

U.S. PATENT DOCUMENTS

| | | | | |
|---|---|---|---|---|
| 162,406 | A | 4/1875 | Nickerson et al. | |
| 542,646 | A | 7/1895 | Jones et al. | |
| 713,269 | A | 11/1902 | Wright | |
| 1,417,604 | A | 5/1922 | Jamison | |
| 1,501,226 | A | 7/1924 | Malbaff | |
| 1,564,320 | A | 12/1925 | Callahan | |
| 2,148,516 | A | 2/1939 | Thompson | |
| 2,153,094 | A | 4/1939 | Maier | |
| 2,184,437 | A | 12/1939 | Saxe | |
| 3,016,767 | A | 1/1962 | Egan et al. | |
| 3,136,767 | A | 6/1964 | Burns | |
| 3,222,940 | A | 12/1965 | Chastain | |
| 3,310,988 | A | 3/1967 | Gault | |
| 3,371,554 | A | 3/1968 | McCray et al. | |
| 3,406,581 | A | 10/1968 | Eyler et al. | |
| 4,051,736 | A | 10/1977 | Jones | |
| 4,306,463 | A * | 12/1981 | King | 74/99 R |
| 4,321,837 | A | 3/1982 | Grigsby | |
| 4,492,126 | A | 1/1985 | Davis | |
| 4,505,162 | A | 3/1985 | Hoh et al. | |
| 5,528,947 | A * | 6/1996 | Wang et al. | 74/41 |
| 6,450,050 | B1 * | 9/2002 | Luo et al. | 74/41 |
| 6,655,224 | B1 * | 12/2003 | Ji et al. | 74/41 |
| 2011/0314959 | A1 * | 12/2011 | Smith | 74/590 |

OTHER PUBLICATIONS

"Energy-Saving Pumping Units," url <http://www.china-ogpe.com/buyingguide_content/Energy_saving_pumping_units_694.html>, Date Unknown (3 pages).

* cited by examiner

*Primary Examiner* — Adam D Rogers

(57) ABSTRACT

A counterbalance system for a cantilevered beam pumping unit includes a counterbalance support structure adapted to be mounted in an operating position on the cantilevered beam of the pumping unit. A suspension element is connected to the counterbalance support structure so as to depend from a suspension end of the counterbalance support structure, and a counterbalance weight is connected to the first suspension element in a spaced apart relationship with respect to the counterbalance support structure. A stabilizer device is connected to the counterbalance weight via a first pivot connection and is connected to a structure separate from the counterbalance weight via a second pivot connection.

6 Claims, 11 Drawing Sheets

COUNTERBALANCE SYSTEM FOR PUMPING UNITS

CROSS-REFERENCE TO RELATED APPLICATION

The Applicants claim the benefit, under 35 U.S.C. §119(e), of U.S. Provisional Patent Application No. 61/622,379 filed Apr. 10, 2012, and entitled "Counterbalance System for Pumping Units." The entire content of this provisional application is incorporated herein by this reference.

TECHNICAL FIELD OF THE INVENTION

The present invention relates in general to methods and apparatus for reducing the energy requirements for operation of an oil well pump jack or other reciprocating pumps with a unique counterbalance system, reducing operational work of the drive system.

BACKGROUND OF THE INVENTION

As a major component of oil and gas production, reciprocating pump jacks are a form of counterbalanced reciprocating pumps that lift oil in wells with insufficient bottom-hole pressure to lift reserve fluids to the surface. The most common of these pumps include an above ground drive unit that produces an effective reciprocating mechanical action from a rotating, counterbalanced crankshaft connected through a walking beam. The pump is positioned "down-hole" at an effective depth that draws directly from underground reserves. The reciprocating down-hole pump can be hundreds or even thousands of feet below the surface, contained within the well casing. The connection to the above ground drive unit or visible pump jack is through long, heavy sucker rods and connecting links. With current technology the reciprocating action of the above ground pump jack raises and lowers the entire length of the sucker rods along with pumped oil and well fluids as the down-hole pump is actuated. The weight lifted with each stroke can sometimes exceed twenty thousand pounds. This requires matching counterweights on the above ground drive. These counterweights can be beam balanced where the counterweights opposing the weight of the down-hole components are located on the walking beam, opposite the pivot point from the down-hole weight. Crank-balanced counterweights are located on the rotating crankshaft of the driving reduction gear, which transforms rotational movement into reciprocating stroke movement. And, combinations and variations of beam and crank-balanced counterweights exist in the form of compound counterweight systems. This in turn requires considerable energy input from a "primary mover" or motor, usually an electric motor. Because the pumping cycle of these pumps produce a relatively low volume of pumped fluids, between 5-40 liters per stroke, long run-times for these pumps can consume relatively large amounts of energy. This energy consumption is part of the calculated "lift cost," which reflects the relative efficiency and profitability of such production wells.

While other pumping schemes exist such as gas injection pumping and different forms of hydraulic pumps or cavity pumps, the familiar pump jack is the most common method to lift oil reserves to the surface. To improve reliability, implementation and repair costs, and, most importantly, production costs, much attention has been focused on this component of oil and gas production since its development around the turn of the twentieth century.

Most attempts to improve the pump jack system of pumping have included improvements in materials of construction, design improvements in critical components such as bearing surfaces, reduction gearing, components and methods of efficient counter-weight balancing, stroke mechanics and overall harmonics of rotary and reciprocal actions and the use of frequency drive systems to more efficiently match mechanical harmonics to motor drive output throughout the pump cycle, which can produce improvements in efficiency. Reducing down-hole weights which must be lifted with each pumping cycle by use of lighter weight components can reduce pumping work directly. The benefits of lighter weight down-hole components sometimes are off-set by increased failure rates and reduced capacity.

SUMMARY OF THE INVENTION

The current device provides a means to counterbalance the down-hole weights of a reciprocating pumping unit, while substantially eliminating ineffective horizontal translations of these weights, more efficiently offsetting the vertical translations of the down-hole weights with each stroke of the reciprocating pump unit. This substantially eliminates a significant portion of ineffective work associated with a conventionally balanced pumping unit. This reduces the overall work of pumping, energy consumption and thereby, lift costs. One of the core novelties and benefits of this device and methodology is derived from eliminating unnecessary horizontal translations of the counterbalance weights throughout the entire reciprocating stroke cycle of the pump unit. This applies to substantially all current reciprocating pump units. Moreover, this device and methodology does not preclude the use of the other efficiencies described above and does not require any modification or replacement of down-hole components.

The current embodiment represents an attachment and modification of a pre-existing cantilevered beam pumping unit, which uniquely suspends the counterweights as described above and changes the center of gravity as described below, both to reduce work required with each stroke cycle.

This system works with substantially all reciprocating pumps, requiring counterbalancing of down-hole weights across a cantilevered beam. Beam balanced pumps offer similar advantages in terms of reduced drive unit power; however, they suffer reduced stroke length and reduced pump capacity. Also, they become relatively unbalanced at larger angles of walking beam tilt. Therefore, they have been limited to use in relatively shallow wells. Because the only effective work in the reciprocating pump cycle involves the vertical up and down movement of the sucker rod, pump components and the corresponding counterbalanced weights on the other side of the walking beam pivot, any horizontal translation of the counterweights is ineffective work. In the common crank-balanced pump the rotation of the counterweights mounted on the crankshaft has a horizontal force vector in all but the twelve and six o'clock positions. Reducing this to horizontal and vertical vectors only, fifty percent (50%) of the work used to move the counterweights is horizontal, and thus ineffective. Because the drive unit directly effects counterweight movement and indirectly moves the rod-pump complex through the walking beam, only the vertical forces on the counterweights produce vertical movement on the down-hole pump components. Thus fifty percent (50%) of the power drive unit work can be ineffective in pump output. Frequency driving the primary mover unit differentially in different portions of the rotational cycle can reduce power consumption during less vertically efficient portions of the rotational stroke cycle. However, because the vertical and horizontal components cannot be completely isolated, the reduction of ineffective power consumption is limited.

By substantially removing the pre-existing counterweights and placing appropriate counterweights on the current device, the crankshaft-pitman arm complex becomes relatively unloaded and functions only as the actuator of reciprocating movement and not the means of counterbalance. Moreover, the counterweights on the cross jack move only in a corresponding vertical direction, without wasted horizontal movements: this utility is accomplished by the current device along with preservation of stroke length and pump output. The counterweights mounted on the crankshaft of larger pumping units can be tens of thousands of pounds in very deep wells, with horizontal translations of over eight feet per stroke. This translation occurs at rates of twelve to twenty strokes per minute. This can result in significant levels of wasted work, which can be eliminated with the current device.

Another potential source of inefficient work is produced by the placing the pivoting fulcrum of the cantilevered beam of most pumping units at the bottom of the walking beam. While this aids in installation and longitudinal adjustment of the walking beam, it creates both beneficial and non-beneficial torque forces around the pivoting fulcrum of the walking beam as it moves to any angle other than exactly horizontal. Also, to a point, the greater the tilt away from the horizontal orientation, the greater the torque force produced and the more relative unbalance is created across the beam. The malalignment of the center of rotation of the beam and its' center of gravity (located in most cases near the center of the walking beam) results in this torque force. As the walking beam tilts from its base on the pivoting mount, the center of gravity near the vertical center of the beam moves radially in the opposite direction of the upward deflection of the walking beam. The center of this radial arc of displacement of the center of gravity is the center of the pivoting point of the walking beam. Therefore, the greater the distance between the vertical center of the walking beam, i.e. the center of gravity and the center of the pivot bearing at the base of the beam, the greater the radius of curvature of the center of gravity displacement. This has little effect on vertical stroke length of the walking beam, but effectively shifts or "walks" the beam horizontally with each stroke. Since the center of gravity is shifted horizontally, the beam becomes more and more unbalanced with the downwardly deflected side of the beam becoming heavier until the beam is vertically oriented. The graphic, mathematical representation of this is a vectored torque arm with the length being the distance of horizontal displacement of the center of gravity. Since the weights borne by the walking beam are tens of thousands of pounds, this induced torque force can be hundreds or even thousands of pounds depending on the width of the walking beam and the angle of beam deflection. As the stroke motion of the pumping motion produces its' work effect by pulling downward on the walking beam through the pitman arms to lift the down-hole rods, pump and lift fluids, it would intuitively seem beneficial to have the torque force add to the downwardly moving side of the beam; however, this only relates to the horizontal orientation and movement downward from that point. Therefore, the side of the walking beam that is down relative to the horizontal, regardless of the direction of movement is heaviest. Therefore, since the added weight of the lift products and the common practice of balancing the beam to leave the downhole side heavier to protect the polished rod and prevent bearing backlash, the induced torque force is not beneficial in the overall scheme; in scaled prototype studies of this device, it can increase work by as much as eleven percent (11%), comparing pivoting from the actual center of gravity versus pivoting from the base of the beam.

As part of the utility of this device, the design through use of outrigger beams suspended by the transverse beams at their terminal mounts not only balance the walking beam longitudinally, they shift the center of gravity of the walking beam toward the pivoting bearing at its' base: therefore, they reduce the induced torques outlined above, again reducing overall work, energy consumption and lift costs. This does not affect vertical stroke length of the pump, but does improve the harmonic balance of the pump.

Moreover, the current device does not preclude the use of frequency driving to summarily improve efficiency. The device doesn't require significant changes in a pre-existing pump jack. Removal of the crankshaft counterweights (which can be used on the cross jack device) with rebalancing of the pump jack unit with the cross jack in place are all that is required to effect the gain in efficiency, which in scaled prototype studies with the current device was well over fifty percent (50%).

The device and method also uses a uniquely designed curved mounting head on the outrigger beams that support the counterweights. This curved mounting head can be adjusted in many ways to adapt the device and method to any number of different pumping units. It has a mechanism to allow the radius of curvature of the head to be adjusted as needed to keep the suspended counterweights moving vertically without horizontal translation. This adjustment is required because unlike other double headed pumping units which currently exist and connect to pitman arms and counterbalance is adjusted by moving the counterweights along the crankshaft arm with all the incipient drawbacks outlined above, this device balances the counterweights by moving the curved heads and the vertically suspended counterweights longitudinally with respect to the walking beam. As the curved head moves longitudinally, the radius of curvature of the head must change with respect to its distance from the center of the pivoting point in order that the counterweights remain substantially vertical throughout the stroke cycle. Unlike the beam-balanced pumping units where the larger counter weights are difficult to balance because small longitudinal displacements result in large balance swings and they become unbalanced as the walking beam tilts, this device is easier to reach a balance end point and remains balanced throughout the stroke regardless of the tilting angle and amount of counterweight. The curved adjustable heads are also unique in that they can tilt with respect to the end of the outrigger beam and can be raised or lowered to adjust for vertical height with respect to the center of pivot. As the outrigger beams are mounted below the center of pivot as mentioned above to effectively align the overall center of gravity to the center of pivot, the center of the radius of curvature of the heads should horizontally align with the center of pivot, which in this case requires upward vertical displacement of the head with respect to the outrigger beam. The unique adjustable head can also be used independently as a universal horse head with or without this method and art to replacement the custom manufacture or replacement of individual horse heads for conventional pumping units, which could lower manufacturing and parts inventory complexity and costs. The curved head also tilts with respect to its mount to allow final adjustment to eliminate any horizontal displacement of the suspended cable throughout the stroke movement. To avoid additional undesired weight while maintaining structural strength. The curved heads utilize premanufactured air bag lifts to resist compressive forces on the head as it tilts. As the radius of curvature of the head is changed the air bags can be inflated or deflated to create the new structural rigidity required at that curvature. To keep the loaded suspended cable supported along its course over the curved head, it rides over specialty chain that creates a continuous channel for the cable's path while automatically adjusting itself to any change in the radius of curvature. The curved heads suspend the counterweights through suspensory cables to a transverse equalizer bar. Each head suspends an independent equalizer bar with two independent cables. This redundancy reduces the chance for failure and damage to other components if a single cable breaks. The equalizer bar directly attaches to the counterweights removed from the crankshaft of the pumping unit in retro-fit situations and/or to OEM counterweights. The entire device is either clamped and/or bolted over the pre-existing walking beam to minimize installation time and cost. The device and method also minimize the complexity of setup to improve the consistency of efficiencies gained. In a scaled, prototype tests the work saved through the methodology and device described above resulted in a fifty-six percent (56%) reduction in KW-hour consumption of power, as compared to an equally balanced and loaded crankshaft-balance configuration control. In fact, the work required to turn the reduction gear as the mode of articulation in the test case without any load was the limiting factor in baseline power consumption reduction. With this in mind, further reductions in work and power consumption could be achieved with the current device and method if the primary mover and reduction gear of the pre-existing pumping unit were eliminated by possibly disconnecting the pitman arms from the walking beam after the device described above is installed as described above; a hydraulic, electric or magnetic linear actuator could be used to articulate the walking beam, allowing the pumping unit to operate off-grid through a small tied solar panel array or a small wind turbine. Power consumption in this configuration could be in the five (5) KW range or less, making this very economically feasible. Again, this reduction in power consumption is attainable while maintaining pump output. If the regeneration time of the oil well was at night, theoretically, the well could operate completely independent of the power grid with enormous lift cost savings.

In addition to lift cost savings through reduced energy consumption, unloading the crankshaft loads can reduce maintenance costs and increase component longevity and reduce component failure.

These and other advantages and features of the invention will be apparent from the following description of the preferred embodiments, considered along with the accompanying drawings.

DESCRIPTION OF ILLUSTRATIVE EMBODIMENTS

Figure 1:
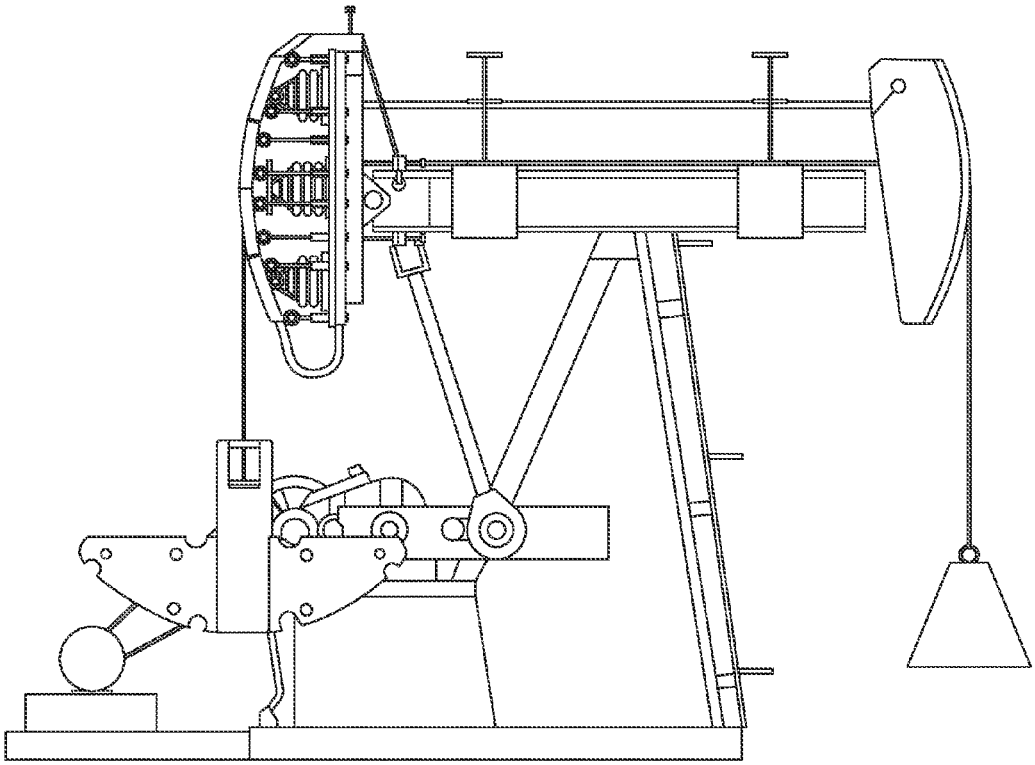
FIG. 1 is a schematic of a pumping unit with a mounted Cross Jack counterbalance system.
Figure 2:
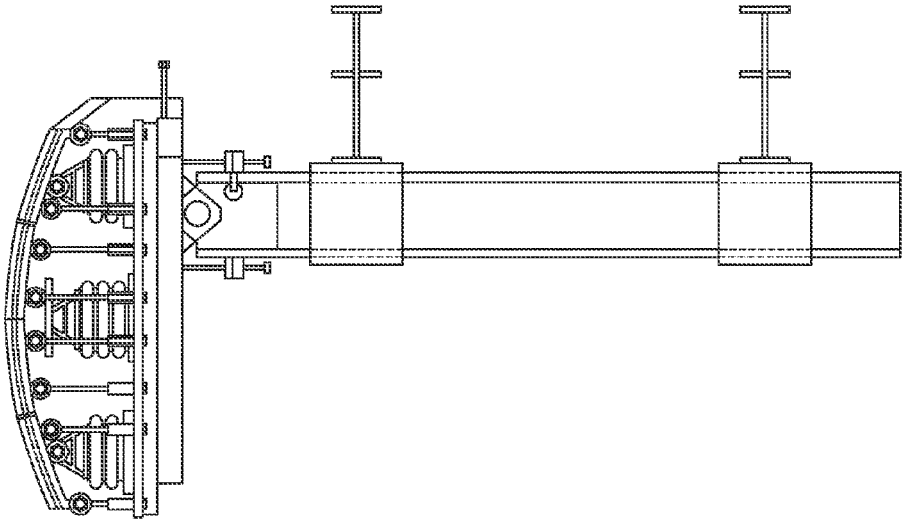
FIG. 2 is a schematic of the side view of the Cross Jack counterbalance system.
Figure 3:
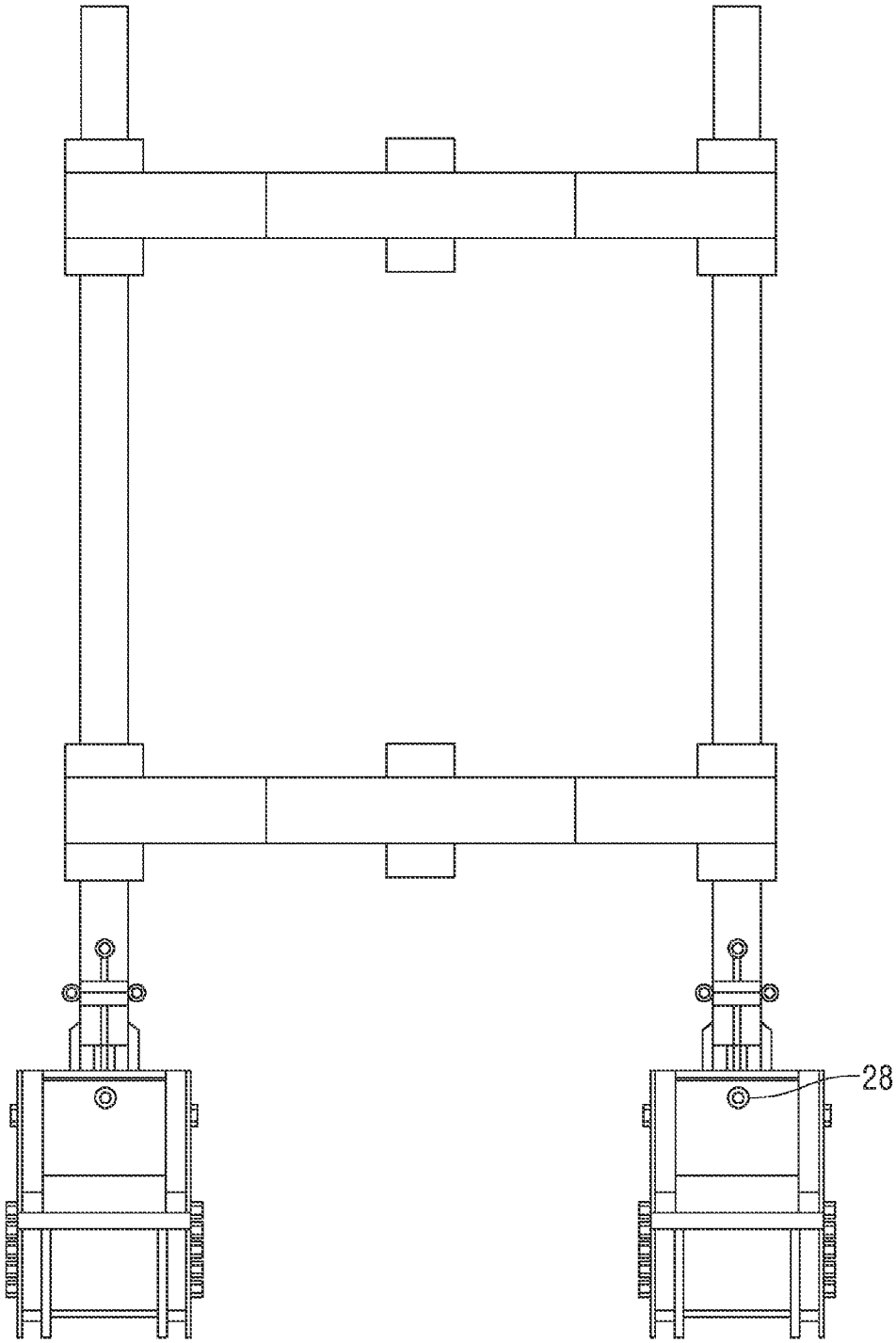
FIG. 3 is a schematic of the top view of the Cross Jack counterbalance system.
Figure 4:
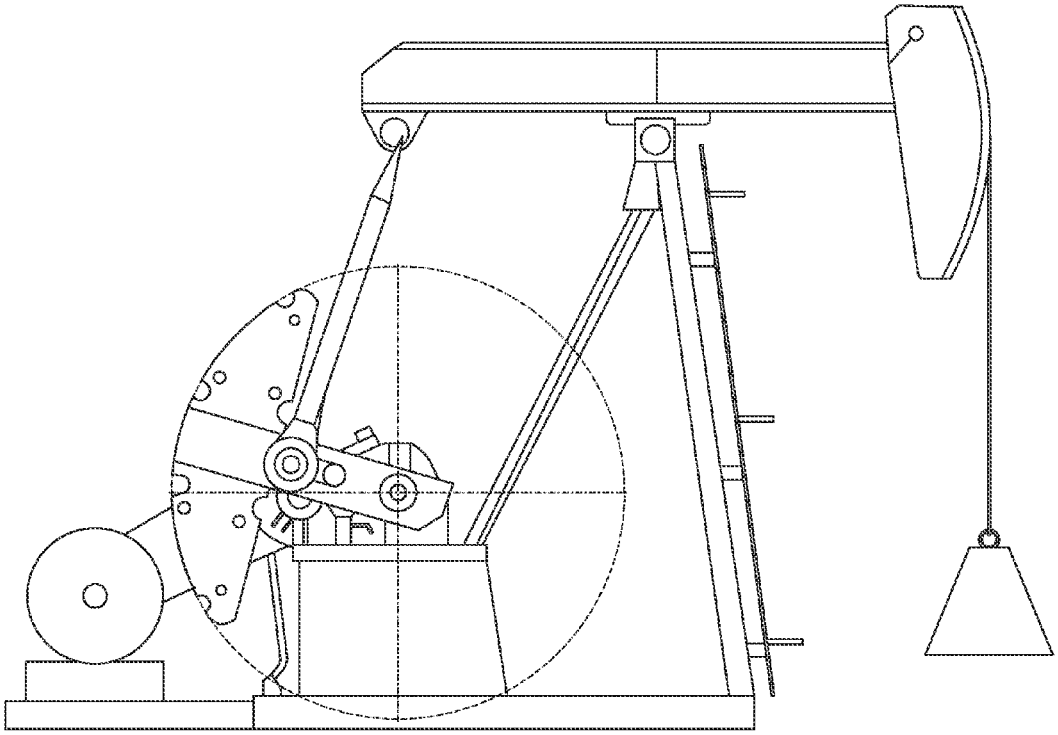
FIG. 4 is a schematic of translational vectors of counterweight movement with each pump stroke.
Figure 5:
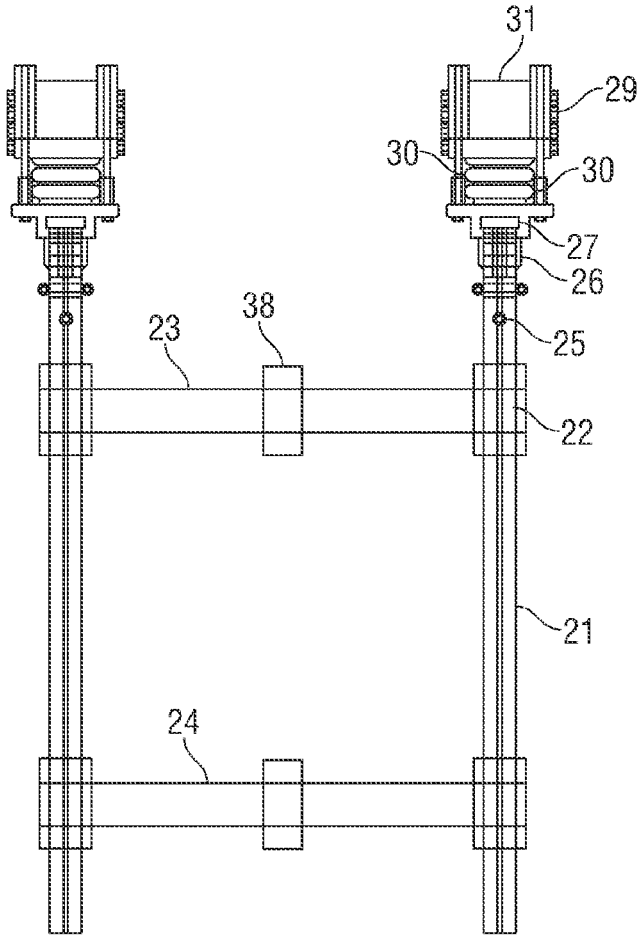
FIG. 5 is a schematic of the bottom view of the Cross Jack counterbalance system.
Figure 6:
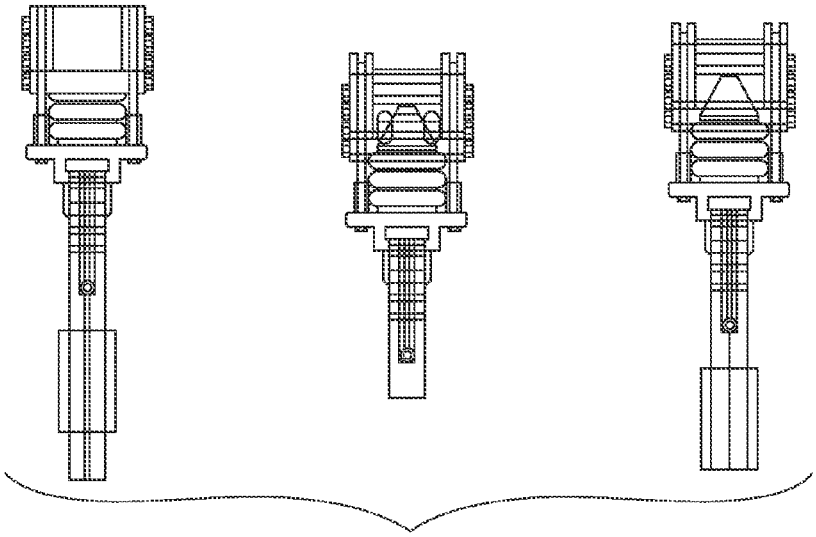
FIG. 6 is a schematic of the curved head complex detail in bottom view.
Figure 7:
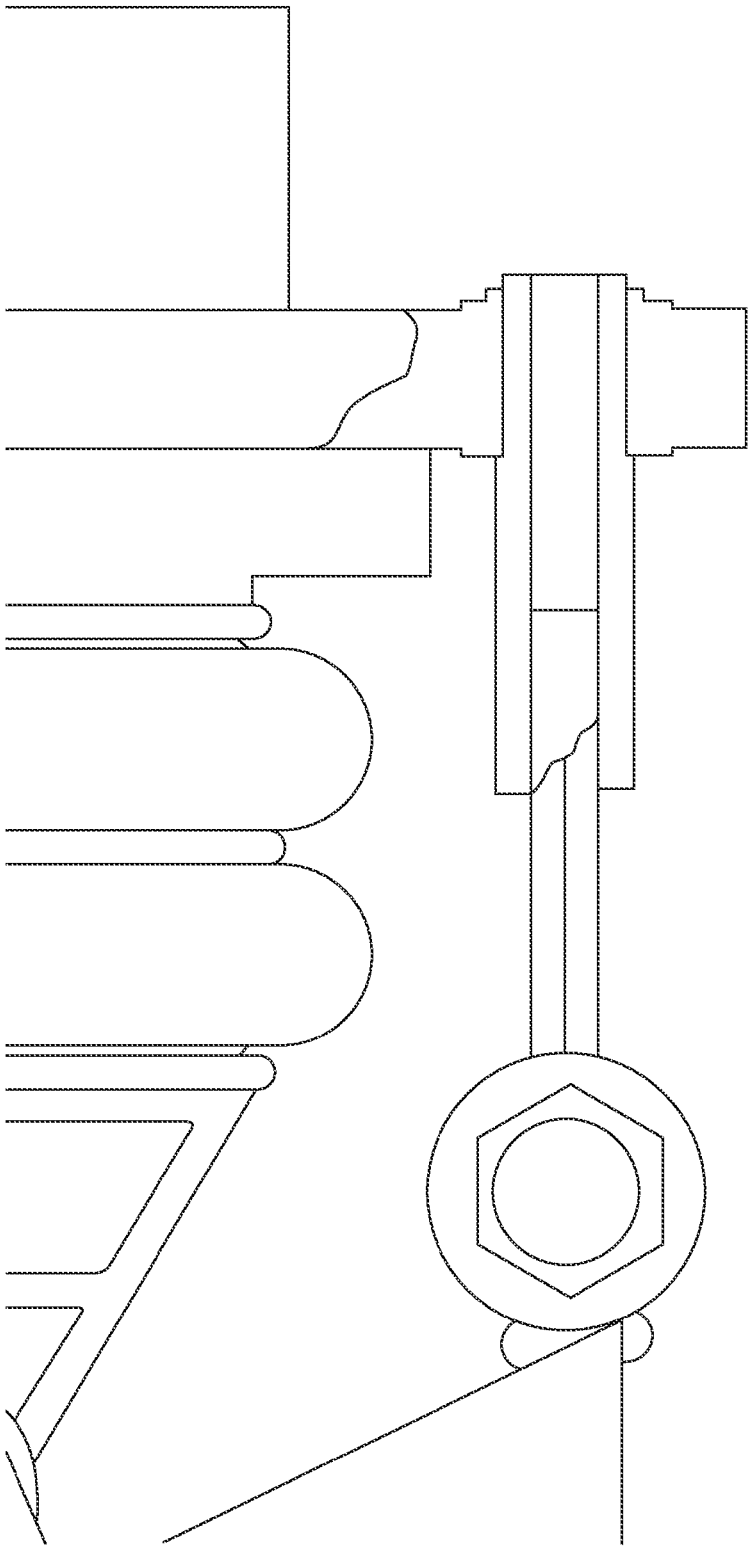
FIG. 7 is a schematic of the curved head complex adjustable suspension bolt detail.
Figure 8:
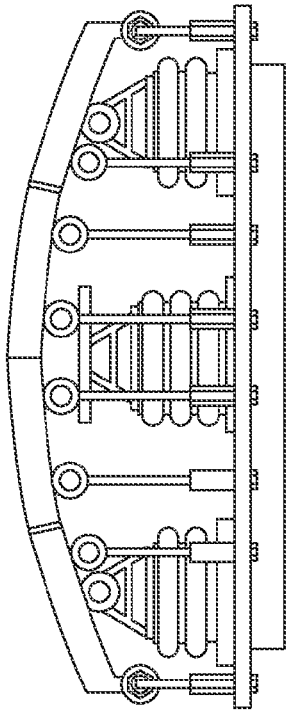
FIG. 8 is a schematic of the side view of curved head complex.
Figure 9:
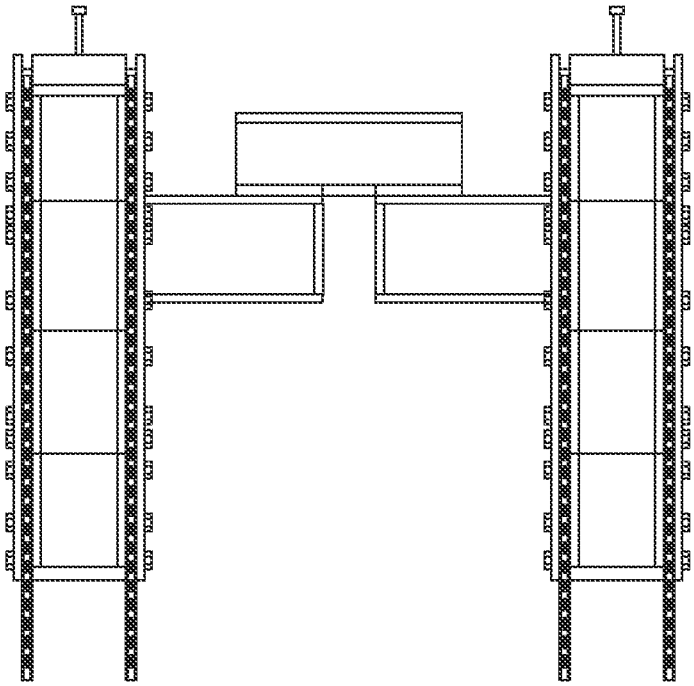
FIG. 9 is a schematic of the end view of Cross Jack counterbalance system.
Figure 10:
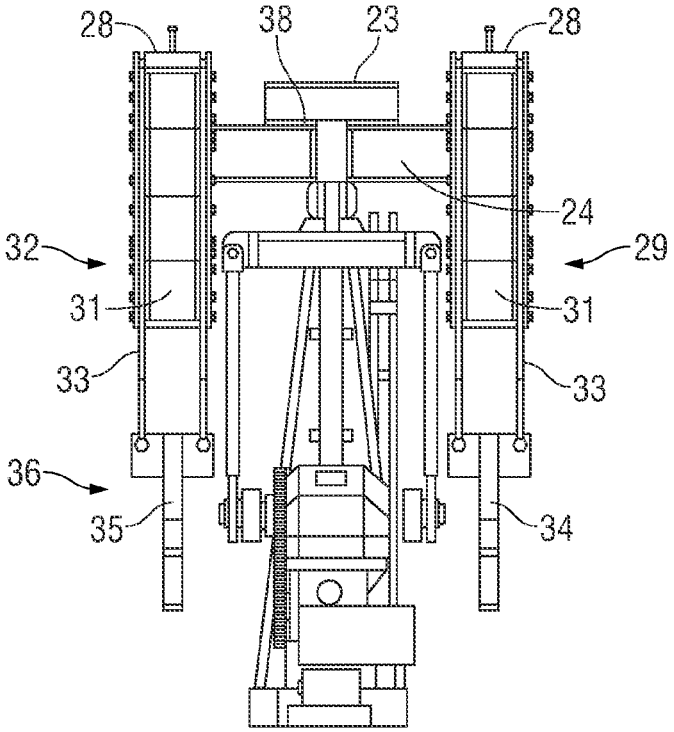
FIG. 10 is a schematic of the end view of mounted Cross Jack counterbalance system.
Figure 11:
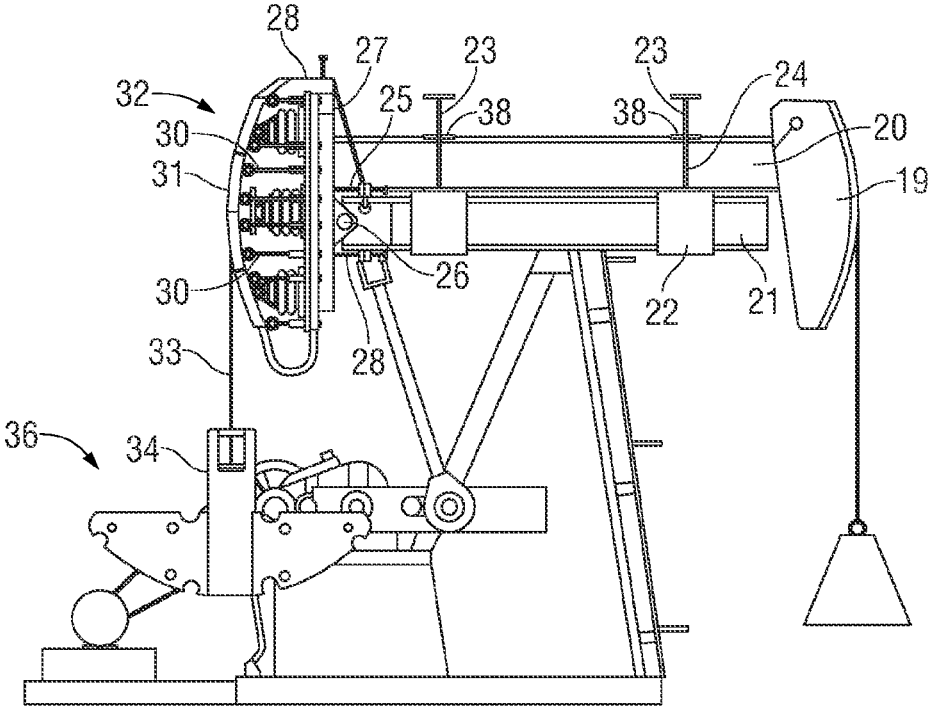
FIG. 11 is a schematic of a pumping unit with the mounted Cross Jack counterbalance system.

The claims at the end of this application set out novel features which the Applicants believe are characteristic of the invention. The various advantages and features of the invention together with preferred modes of use of the invention will best be understood by reference to the following description of illustrative embodiments read in conjunction with the drawings introduced above.

The device and method of implementation of the current art can be retro-fitted onto pre-existing pumping platforms as described above, or it can be the core concept for a new unique pumping unit that incorporates the components, methods and utility of the current art. The embodiment of the current device includes attachable components which reduce the work performed by a reciprocating pumping unit whether the down-hole weights are beam balanced, crankshaft balanced or compound balanced by uniquely counterbalancing them in this non-obvious manner, which eliminates the wasted work of horizontal translation of said weights while simultaneously reducing or eliminating unwanted induced torque forces produced by the mal-alignment of the center of gravity of the walking beam complex and the center of pivot of said beam complex. The methodology of setup and implementation of the device of the current art accomplishes the following utility:

a) The device installs and operates in a manner that does not require replacement or alteration of down-hole components;

b) The device installs in a clamp-on and/or bolt-on manner, while it may be permanently affixed, which requires minimal alteration of the pre-existing pumping unit and can be mounted on existing or new installation platforms;

c) The device design and method of implementation allow for relatively rapid and inexpensive installation and setup, possibly within the regeneration period of an operating oil well, so that no loss of productivity is associated with implementation;

d) The method of implementation involves a device design that can be fitted universally without significant required customization to a variety of different pumping unit makes and models within the same pump capacity range, allowing for standardization of the resultant energy savings and predictable reduction in lift costs; moreover, it can be installed on beam balanced, unitorque, crankshaft balanced and compound balanced pumping platforms;

e) The method of implementation does not require a "workover rig" and does not disturb or put an additional risk on the down-hole components of the well;

f) The device can be implemented along with other cost-saving devices and methods such as frequency driving and fiber rod technologies;

g) The device and method of implementation allows the installation to result in an optimal harmonic pumping motion, which maximizes pump volume with each stroke without adding increased stresses on rod or pump components;

h) The device and method of implementation make the device inexpensive to maintain, have relatively long duty cycles and be reliable:

i) The device and method of implementation allow relatively unimpeded access for service of the pumping unit and down-hole components;

l) The device and method of implementation can lower stress loads on critical pump unit components and require less maintenance costs and down times;

k) The device and method of implementation can be expanded from reducing energy consumption only to that of creating and off-grid configuration that dramatically reduces or completely eliminates power grid dependence and is economically feasible and potentially profitable;

l) The device and method of implementation can be placed in any environment or climate that a conventional pump unit can be placed; and, m) The configurable curved head of the device can be used with or without the current mode of implementation to replace a conventional horse head unit and allow standardization of different pump units with respect to the horse head.

Referencing the drawings above, the description and discussion of the device components will follow the numbering system of the drawings as follows:

19) The horse head of the pre-existing pumping unit attaches to the walking beam (#20) and to the down-hole components through a bridle system of suspensory cables. The down-hole components which include the polished rod, sucker rods, connection components, pump device, well anchor and all liquids, solids and gases that are products of the pumping stroke; they constitute the down-hole weights which are lifted with each stroke.

20) The walking beam of the pre-existing pumping unit is typically and 1-beam-like structure that attaches on one end to the horse head (#19) as described above and is supported in the mid-portion by a mounting structure that allows pivoting or rotation of the walking beam about this fulcrum. At the other end, opposite the horse head, the walking beam connects through a connection bearing structure to an equalizer bar that through pitman arms connect it to the rotating crankshaft of the reducer gear train. This articulates the walking beam to produce the reciprocating stroke that moves the connected pump within the well hole. The walking beam in the current art serves as the mounting point of the current embodiment of this device.

21) The outrigger beams suspend parallel on either side of the walking beam (#20) by the transverse beam outrigger mounts (#22) through which they can be positioned and adjusted longitudinally to effect the balance desired between the counterweights attached opposite the horse head and down hole weights across the pivot mount on the other side. Because the outrigger beams straddle the pivot mount, they can be structurally substantial to support the counterweights without unduly complicating the balance of the composite weights across the pivot point. The outrigger beams terminate on the end opposite the horse head of the walking beam (#19) in mounting components (#25-#28) which attach a curved, adjustable head (#29#32) which suspends the counterweight components (#34, #35) through suspensor cables (#33). The outrigger beams (#21) purposely suspend through the traverse beams (#23, #24) and the transverse beam outrigger mounts (#22) below the vertical level of the pivoting axis of the pivot mount. The composite weights of the device components below the vertical level of the pivot axis and the walking beam weights above the pivot axis produce a new center of gravity that corresponds to the pivot axis rather than the beam center above. This reduces unwanted, induced torque forces as the walking beam tilts without physically moving the pivot axis to the center of gravity above. This can dramatically reduce the work associated with articulating the loaded walking beam.

22) The transverse outrigger beam mounts are located on either side of the walking beam (#20) fore and aft of the pivot mount. These structurally substantial, channel-like structures focally encase and support the outrigger beams while allowing the beams to slide within the channels to adjust the longitudinal position of the beams. The transverse outrigger beam mounts attach at each terminal end of the transverse beam complex (#24). In total, there are four (4) mounts in the embodiment of the current art; two on opposite sides of the pivot point (two on either side of the walking beam). To fixate the outrigger beams (#21) at the desired longitudinal position, the transverse outrigger beam mounts incorporate fixation screws through and through the beam and mown, or through threaded holes in the wall of the mounts.

24) the transverse beam complex contains a duplicity of structural beam-like components on opposite sides of the walking beam (#20) at right angles to the walking beam. A similar beam-like component (#23) affixes to each segment (#24) on either side of the walking beam (#20), while passing over said walking beam while mounting to it with affixed flanges (#38) by way of bolts, clamps or other similar means. A flange-like protrusion (#38) from the mid-portion of the transverse beam segment (#23) represents an area of increased contact surface with the walking beam to facilitate bolting or clamping of the transverse beam complex to the walking beam and to rotationally stabilize the transverse beam components. Each set of transverse beam segments (#24), one on each side of the walking beam and the bridging beam segment (#23) forms a saddle around the adjacent walking beam section. A connecting strap passes under the said section of walking beam to affix to each short beam section (#24), in effect enclosing around the walking beam section. On the opposite ends of each short beam section (#24) a transverse outrigger beam mount (#22) is affixed. One transverse beam complex is attached to the waking beam on either side of the pivot mount. The outrigger beams (#21) on either side of the walking beam (#20) pass through the channel of two transverse outrigger beam mounts (#22), one attached to each transverse beam complex on either side of the pivot mount. The height of the lower transverse beam section (#24) determines the relative vertical position of the outrigger beams and functions to shift the center of gravity as described above. This sectional height is pre-determined before installation of the device and prefabricated before installation.

25, 26) the curved head complex tilt adjustment screws pass through threaded holes in the terminal rigid mounts on the top and bottom of the outrigger beams to press against the curved head complex mounting plate which tilts by means of a single axis hinge pin (#26). Screw adjustment allows proper positioning of the curved head complex to facilitate vertical translation accuracy of the suspension cables (#33) and the counterbalance complex (#34, #35, #36).

28, 29) The vertical height adjustment screw positions the vertical height of the curved head complex relative to the pivot point by pushing downward on the terminal end mounting flange of the outrigger beam (#27), thus raising the curved head complex through an articulating slot (427) on the curved head mounting plate into which the terminal end mounting flange of the outrigger beam slides. The vertical height adjustment screw passes through a threaded hole in a structurally dense plate that comprises the top portion of the curved head complex. This plate has two grooved channels in the top surface that receives and transmits the suspending cables (#34) which originate at the terminal ends of the outrigger beams (#21). The top plate also affixes the chain conduit (#29) that directs and supports the suspending cables (#33) against the front face (#31) of the curved head complex. The top structural plate is affixed, rigidly to the curved head complex mounting plate.

30) The curved head complex adjustable suspension bolts (#30) bridge between the curved head complex mounting back plate and the front face plates (#31). At the back plate fixed, rotating bushing nuts receive threaded bolts that can be lengthened and shortened by rotating the fixed bushing nuts. The threaded bolts terminate at the other end into threaded holes in articulating pins that pass through fixed bushings affixed to the back of the front face plates (#31). These bolts act as structural members for the curved head complex. By lengthening or shortening these bolts in concert over the span of the curved head complex, the curvature of the front face of the curved head complex can be changed. These bolts form structural rows on either side of the head complex.

31) The front face plates of the curved head complex are curved, channeled structural plates which in unison create the front face of the head complex and define collectively the radius of curvature of the entire head complex. The back surface of the front face plates have fixed bushings which articulate through receiving pins with the adjustable suspension bolts (#30). By adjusting the four suspension bolts on each front face plate, the collective curvature of the head plate can be steepened or flattened. The air bag structural members (#32) affix or abut against the rear of the front face plates to reinforce the rigidity of the plate section. To improve the continuity of the non-contiguous collective curvatures of the front face plates, a specialized chain conduit (#29) travels along grooved channels on each side of the front face plates. The chain conduit affixes to the top plate of the head complex and follows channel-like grooves within the individual front face plates and are held in position by pressure from the overlying suspension cable within a spine formed channel of the chain. An excess of chain extends beyond the lower edge of the head complex and redundantly extends and affixes to the bottom edge of the curved head mounting back plate. As the head expands with steeping of the radius of curvature, the excess chain moves onto the front face, which keeps the cable groove continuous. Each curved head complex has two grooved chain conduits for two cables per head.

32) Air bag structural members form a central line within the curved head complex to create an adjustable reinforcement of the head complex to resist compressive collapse from forces of the loaded suspension cables and the outrigger beams as the downward force of the counterweights resists deflection by the curved front surface of the curved head complex. These air bag structural members can be inflated or deflated through needle valves to maintain the desired radius of curvature as adjusted by the suspension bolts (#30) while imparting adequate structural rigidity.

33) The suspension cables originate as a loop through an eyelet in the terminal end of the outrigger beam, follow ring eyelets at the top of said beams where the loops close atop the beams with cable clamps and extend over the top of the curved head complex to follow the grooves and chain conduits as described above. As the walking beam tilts, the radius of curvature of the head complex keeps the suspension cable within the prescribed vertical path. The suspension cables terminate in eyelets on the transverse equalizer bars (#36) of the counterbalance complex (#34, #35, #36).

34, 36) the counterbalance complex comprises a transverse equalizer bar (#36) and a vertical mounting point (#34) to facilitate counterweight attachment. The transverse equalizer bar travels only in a vertical path by way of the suspension cables (#33) and the curved head complex. The bar overhangs the primary mover-reducer gear complex: however, the width between said bars prevents interference with these components while providing adequate stroke movement and ground clearance. The stroke length of the counterbalance complex exactly equals the stroke length of the polished rod and connected down-hole components.

35) The counterweights attach to a slotted receiver on the transverse equalizer bar, bolting in place. The counterweights can be recycled from their previous crankshaft placement on the pre-existing unit or can be OEM weights provided with the device. If the weights are recycled from the pre-existing pump unit, the mounting points on the transverse equalizer bar must be customized to match those of the pump unit crankshaft. Using dedicated OEM counterweights can standardize the mounting points on the transverse equalizer bar. The amount of counterweight used can be equal to that required for typical crankshaft balancing. Completion of balance with the device in place can be accomplished by sliding the outrigger beams in or out, thereby moving these counterweights to reach the desired balance end point.

Figure 12:
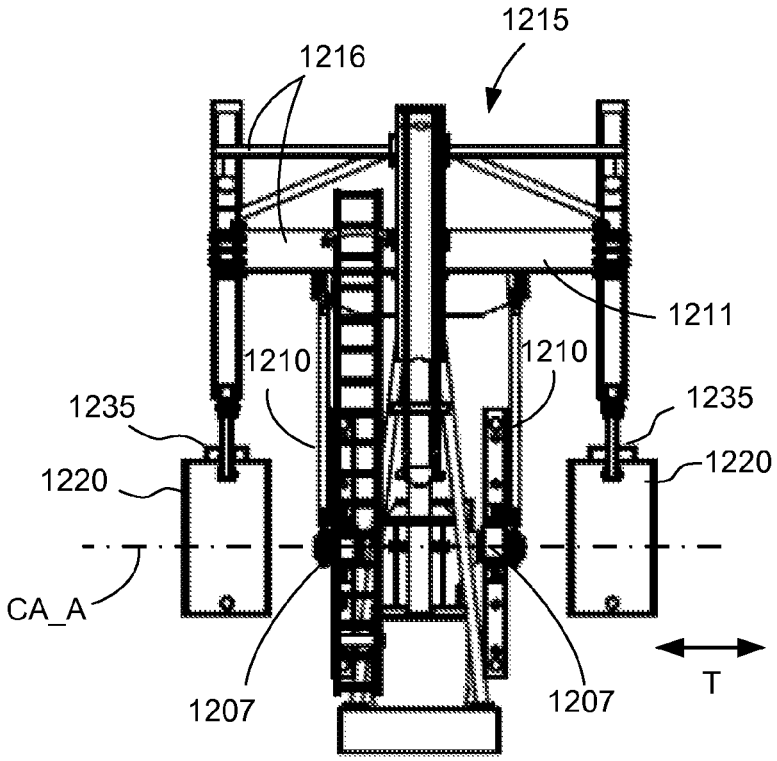
FIG. 12 is a front view of a pumping unit having an alternate counterbalance system mounted thereon.
Figure 13:
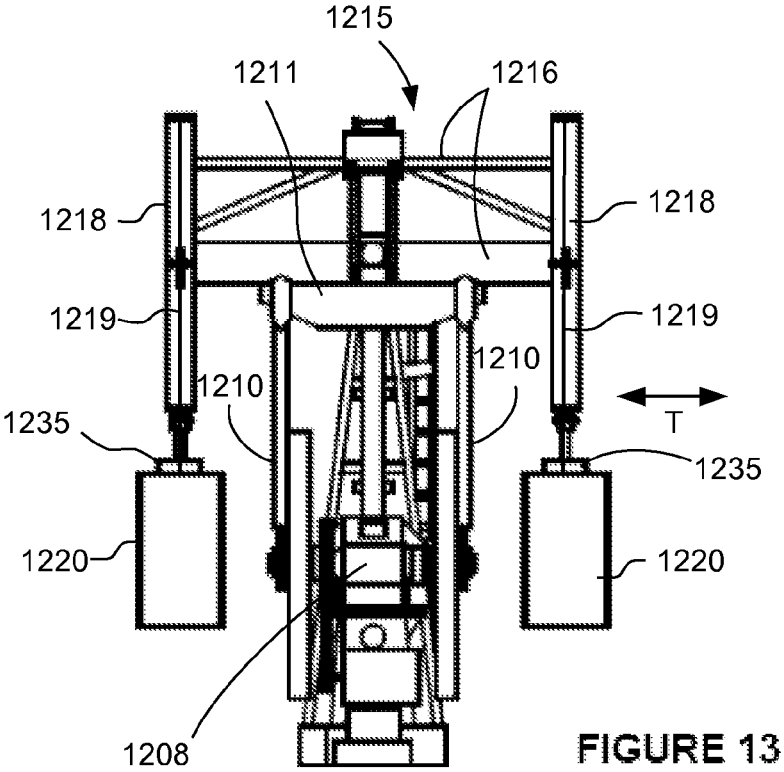
FIG. 13 is a rear view of the pumping unit and counterbalance system shown in FIG. 12.

FIGS. 12 through 16 show another embodiment of a counterbalance system embodying the principles of the present invention. Referring particularly to FIGS. 12 through 15, a pumping unit 1200 with which the counterbalance system may be used includes a cantilevered beam or walking beam 1201 mounted on a saddle bearing (obscured in the drawings, but well known in the art) so as to be pivotable with respect to a support or Samson post 1202. The pivot axis SB_A shown in FIG. 14 extends perpendicular to the plane of the drawing. Pumping unit 1200 also includes a horse head 1203 at a front end of beam 1201, and a support cable arrangement 1205 (commonly referred to as a bridle) which ultimately supports the weight of the sucker rod string (not shown) extending to a subsurface reciprocating pump (also not shown). Pumping unit 1200 further includes a motor receiving area 1206 (shown in FIG. 14) in which a suitable motor (not shown) may be installed to drive crank arms 1207 through suitable gearbox 1208 which is shown in FIG. 13, but mostly obscured in the other figures. Pumping unit 1200 includes a respective crank arm 1207 on either lateral side of gearbox 1208. A respective pitman arm 1210 is pivotally connected at one end to a respective crank arm 1207 and at the opposite end to a cross member 1211 (shown in FIGS. 12 and 13) connected to cantilevered beam 1201. Rotation of the crank arms 1207 about axis CA_A shown in FIG. 12 causes pitman arms 1210 to reciprocate cantilevered beam 1201 about the saddle bearing axis SB_A.

Figure 14:
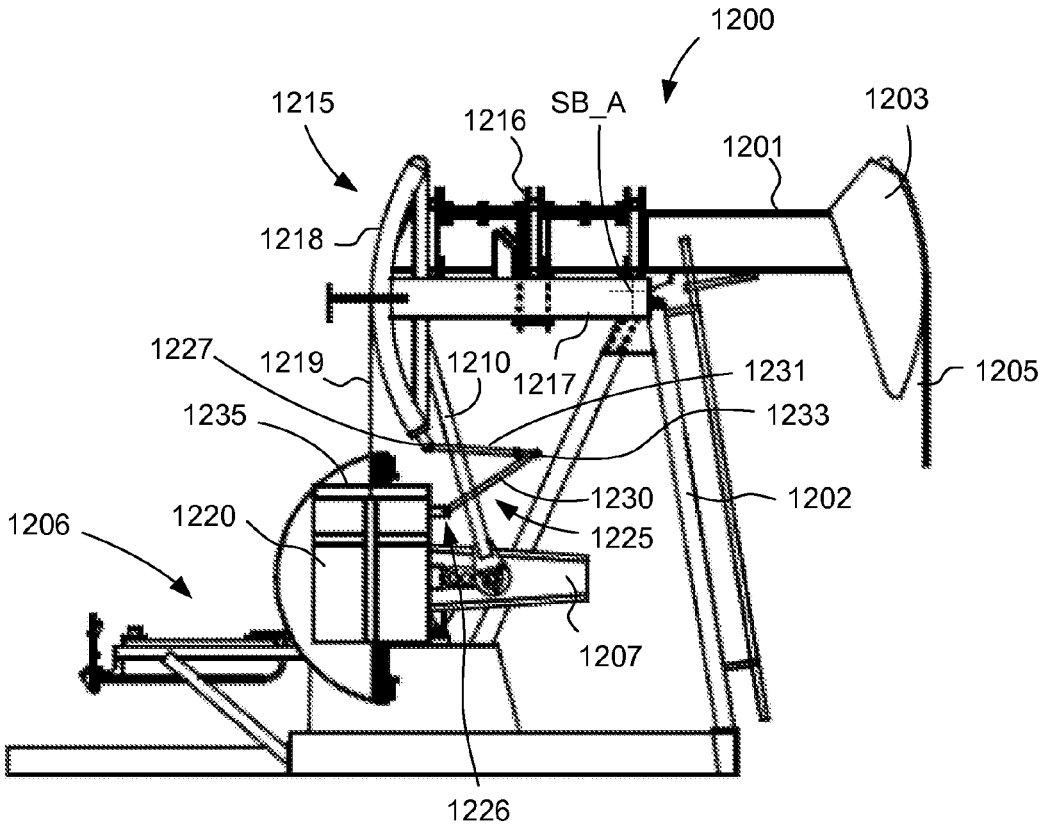
FIG. 14 is a side view of the pumping unit and counterbalance system shown in FIG. 12.
Figure 15:
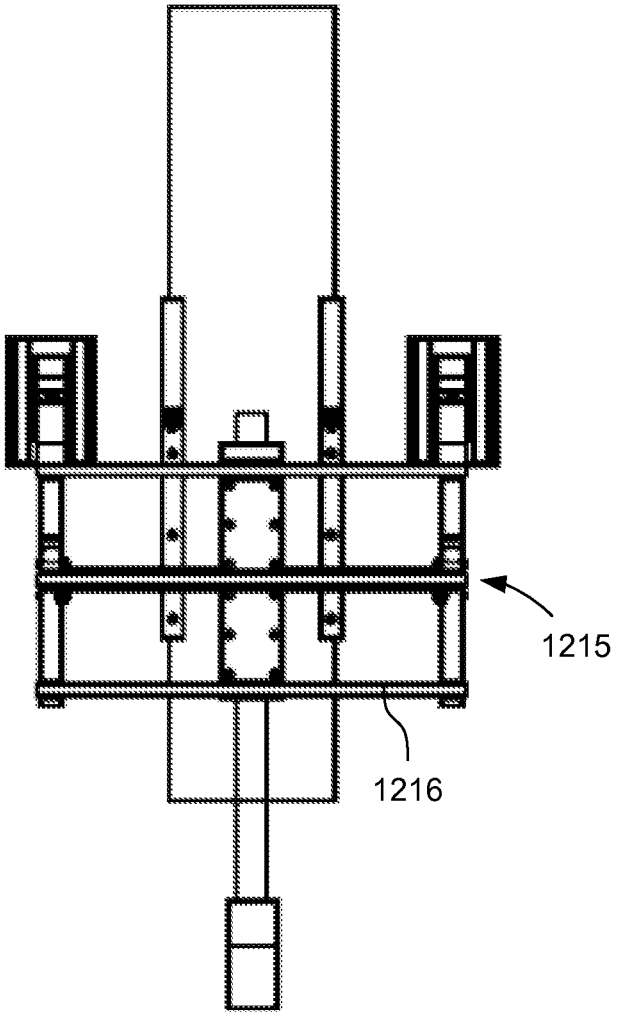
FIG. 15 is a somewhat diagrammatic representation of a top view of the pumping unit and counterbalance system shown in FIG. 12.

The counterbalance system is shown generally at 1215 in FIGS. 12 through 14 and is adapted to be mounted on cantilevered beam 1201. As with the embodiment shown in the earlier figures, the counterbalance system includes a support structure 1216 and first and second outrigger members 1217.

Each outrigger member 1217 has a rear facing horse head 1218 and a suspension element 1219. A respective counterbalance weight 1220 is connected to the lower end of the respective suspension element. As with the earlier-described embodiments, each suspension element 1219 supports its respective counterbalance weight 1220, and the combined counterbalance weights 1220 are intended to essentially match the weight expected on the bridle 1205 to minimize the energy required to turn crank arms 1207 and drive the pumping unit to operate the down hole pump (again, the down hole pump not being shown in the figures).

Unlike the embodiment shown in the previous drawings, the embodiment shown in FIGS. 12 through 16 further includes a respective stabilizer arrangement adapted to stabilize the counterbalance weights from lateral motion, that is, motion transverse to the plane of the drawing in FIG. 14 in the direction T shown in FIGS. 12 and 13. As shown best in FIG. 14, the illustrated stabilizer arrangement includes a respective stabilizer device 1225 for each respective counterbalance weight. Each stabilizer device 1225 includes at least a first pivot connection 1226 to the respective counterbalance weight 1220 and a second pivot connection 1227 to a structure separate from the counterbalance weight, in this case the respective rear facing horse head 1218. More particularly, the illustrated stabilizer device 1225 comprises an articulating arm made up of a first arm portion 1230 connected to the counterbalance weight 1220 via the first pivot connection and a second arm portion 1231 connected to the separate structure via the second pivot connection 1227. A third pivot connection 1233 connects the first arm portion 1230 to the second arm portion 1231. It will be appreciated that the pivot connections associated with stabilizer device 1225 comprise joints which allow rotation only about a respective axis which extends perpendicular to the plane of the drawing in FIG. 14. For example, each pivot connection 1226, 1227, and 1233 may include a pair of laterally spaced bearings each mounted on an elongated hinge pin which has a longitudinal center axis aligned with the axis of rotation for the respective pivot connection. This pivot arrangement allows the articulating arm to move in a plane parallel to the plane of motion of cantilevered beam 1201 during the operation of pumping unit 1200. However, the pivot points resist movement of the stabilizer laterally, in direction perpendicular to the plane of motion of cantilevered beam 1201. This resistance to lateral motion prevents or reduces any lateral swinging of the respective suspended counterbalance weight in response to lateral wind loading or other lateral forces which may occur.

It will be appreciated that the counterbalance system, both the embodiment shown in FIGS. 12 through 16 and the embodiment shown in the earlier figures, is specifically designed as a retrofit device to a prior standard pumping unit. Thus the previously illustrated counterbalance system includes the outriggers from which the counterbalance weights are suspended. These outriggers are necessary to position the counterbalance weights laterally of the pumping unit gearbox, crank arms and any weights associated with the crank arms. It is possible, however, to design a pumping unit from the ground up to include a suspended rear counterbalance weight to counterbalance the weight on the forward horse head of the pumping unit. In the case of such a purpose-built pumping unit, the crank arms, gearbox, and motor may be located so that the counterbalance weight may be suspended directly from the back of the cantilevered beam of the pumping unit. Such a configuration could allow a single suspended counterbalance weight unlike the two laterally spaced counterbalance weights shown in the figures. A single stabilizer device such as that shown particularly in FIG. 14 may be used to stabilize a single suspended counterbalance weight from lateral movement induced by wind or otherwise.

In the form of the invention shown in FIGS. 12 through 16, each counterbalance weight may include a weight container which provides a volume adapted to receive weighting elements to provide the desired counterbalance weight in the operation of the pumping unit. The volume for receiving weighting elements in the weight container may be accessible through an opening which is covered by a lid such as lid 1235 shown in FIGS. 12 through 14. The ability to vary the weight of the given counterbalance weight device simplifies balancing the pumping unit 1201 by allowing the device to be balanced solely by adding the appropriate amount of weighting elements (which may be metal shot or small disks) rather than adding or swapping out large weights or plates as has been traditionally done in prior art pumping unit counterbalance systems and techniques.

Figure 16:
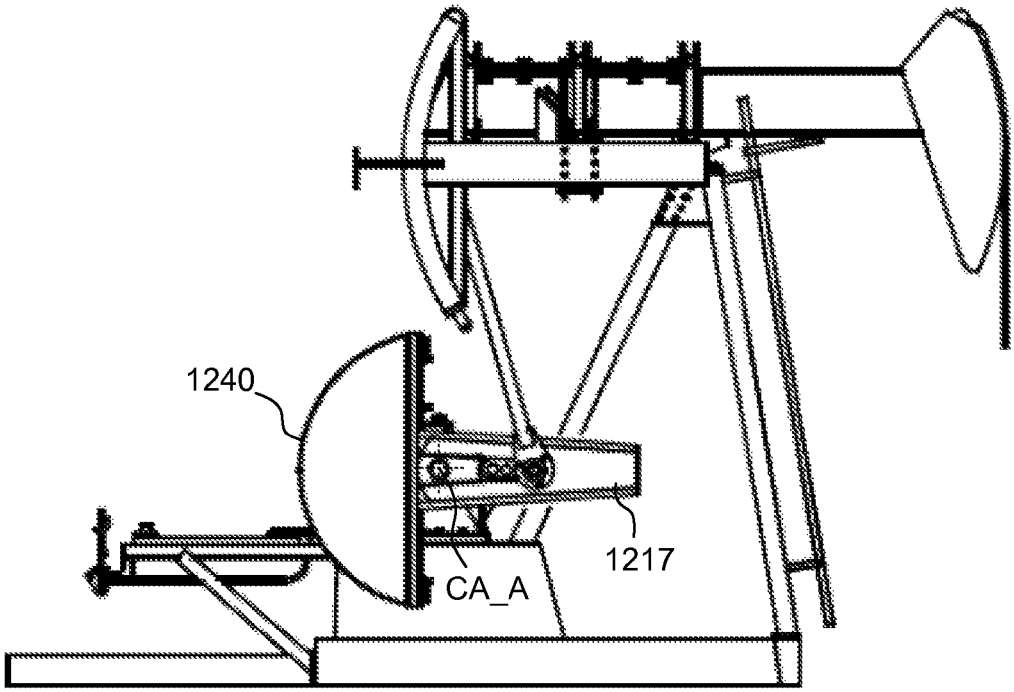
FIG. 16 is a side view of the pumping unit and the counterbalance system similar to FIG. 14, but showing the suspended counterbalance weights removed so as to better show the balance arrangement for the crank arm of the unit.

FIG. 16 is similar to FIG. 14 but has the counterbalance weights 1220 and stabilizer device 1225 removed to provide a better view of the crank arm 1207 and crank arm counterbalance weight 1240. It should be noted that the crank arm counterbalance weight 1240 is located on the opposite side of the axis of rotation CA_A from the crank arm 1207 (axis CA_A extends perpendicular to the plane of the drawing in FIG. 16). The purpose of the crank arm counterbalance weight 1240 is not to counterbalance weight acting on the forward horse head 1203 of pumping unit 1200, but simply to balance the crank arm 1207 so that the crank arm 1207 and crank arm counterbalance weight 1240 have the effect of a balanced fly wheel which is weighted symmetrically with respect to the axis of rotation for the crank arm, axis CA_A.

As used herein, whether in the above description or the following claims, the terms "comprising," "including," "carrying," "having," "containing," "involving," and the like are to be understood to be open-ended, that is, to mean including but not limited to. Any use of ordinal terms such as "first," "second," "third," etc., in the claims to modify a claim element does not by itself connote any priority, precedence, or order of one claim element over another, or the temporal order in which acts of a method are performed. Rather, unless specifically stated otherwise, such ordinal terms are used merely as labels to distinguish one claim element having a certain name from another element having a same name (but for use of the ordinal term).

The above described preferred embodiments are intended to illustrate the principles of the invention, but not to limit the scope of the invention. Various other embodiments and modifications to these preferred embodiments may be made by those skilled in the art without departing from the scope of the present invention.

The invention claimed is:

1. A counterbalance system including:

(a) a counterbalance support structure adapted to be mounted on a cantilevered beam of a cantilevered beam pumping unit in an operating position;

(b) a first suspension element connected to the counterbalance support structure so as to depend from a suspension end of the counterbalance support structure when the counterbalance support structure is in the operating position;

(c) a first counterbalance weight connected to the first suspension element so as to be suspended from the counterbalance support structure by the first suspension element;

(d) a first stabilizer device having a first pivot connection to the first counterbalance weight and a second pivot connection to a structure separate from the first counterbalance weight, the first and second pivot connections (i) facilitating movement of the first stabilizer device in a first plane coinciding with, or parallel to, a plane of motion of the cantilevered beam in the operation of the pumping unit, and (ii) resisting movement of the first stabilizer device in a direction perpendicular to the plane of motion of the cantilevered beam.

2. The counterbalance system of claim 1 wherein:

(a) the first pivot connection comprises a first joint allowing rotation exclusively about a first axis of rotation extending perpendicular to the plane of motion of the cantilevered beam; and (b) the second pivot connection comprises a second joint allowing rotation exclusively about a second axis of rotation extending perpendicular to the plane of motion of the cantilevered beam.

3. The counterbalance system of claim 2 wherein the first stabilizer device comprises an articulating arm including:

(a) a first arm portion connected to the first counterbalance weight via the first pivot connection;

(b) a second arm portion connected to the separate structure via the second pivot connection; and (c) a third pivot connection connecting the first arm portion to the second arm portion.

4. The counterbalance system of claim 1 further including:

(a) a second suspension element connected to the counterbalance support structure so as to depend from the suspension end of the counterbalance support structure when the counterbalance support structure is in the operating position;

(b) a second counterbalance weight connected to the second suspension element so as to be suspended from the counterbalance support structure by the second suspension element; and (c) a second stabilizer device having a first pivot connection to the second counterbalance weight and a second pivot connection to a structure separate from the second counterbalance weight, the first and second pivot connections of the second stabilizer device (i) facilitating movement of the second stabilizer device in a second plane coinciding with, or parallel to, the plane of motion of the cantilevered beam in the operation of the pumping unit, and (ii) resisting movement of the second stabilizer device in the direction perpendicular to the plane of motion of the cantilevered beam.

5. The counterbalance system of claim 4 wherein the first counterbalance weight includes a first weight container providing a first volume adapted to receive first weighting elements, and wherein the second counterbalance weight includes a second weight container providing a second volume adapted to receive second weighting elements.

6. The counterbalance system of claim 1 wherein the first counterbalance weight includes a first weight container providing a first volume adapted to receive first weighting elements.

* * * * *